US006196416B1

(12) United States Patent
Seagle

(10) Patent No.: US 6,196,416 B1
(45) Date of Patent: Mar. 6, 2001

(54) DEVICE FOR DISPENSING ARTICLES OF VALUE AND MAGAZINE THEREFOR

(75) Inventor: Donald Lee Seagle, Sandy Valley, NV (US)

(73) Assignee: Asahi Seiko USA, Inc., Las Vegas, NV (US)

( * ) Notice: Subject to any disclaimer, the term of this patent is extended or adjusted under 35 U.S.C. 154(b) by 0 days.

(21) Appl. No.: 09/346,415

(22) Filed: Jun. 30, 1999

(51) Int. Cl.[7] ..... B65H 1/00

(52) U.S. Cl. ..... 221/197; 221/282

(58) Field of Search ..... 221/197, 154, 221/198, 232, 253, 259, 282, 268, 231

(56) References Cited

U.S. PATENT DOCUMENTS 6,050,448 * 4/2000 Willis ..... 221/197

* cited by examiner

*Primary Examiner*—Kenneth W. Noland
(74) *Attorney, Agent, or Firm*—Quirk & Tratos

(57) ABSTRACT

A device and magazine are set for dispensing articles of value such as pre-paid telephone calling cards. The closed magazine has a gate moveable between a closed to an open position to permit articles to be dispensed therefrom by a dispensing mechanism. A one cycle gate operating mechanism is included which has an actuator moveable from a first position to a second position to secure the magazine to the dispensing mechanism and open the gate. Should the actuator be moved to close the gate, the gate is locked in the closed position and cannot be re-opened. Surreptitious opening of the gate to remove cards and then closing the gate prevents the gate from re-opening and prevents securing the magazine to the dispensing mechanism.

12 Claims, 4 Drawing Sheets

DEVICE FOR DISPENSING ARTICLES OF VALUE AND MAGAZINE THEREFOR

FIELD OF THE INVENTION

The present invention relates to devices for dispensing articles of value such as cash or value cards, including prepaid telephone cards, and to magazines for holding a number of such articles for dispensing thereof.

BACKGROUND

Devices for dispensing articles of value are generally known. Articles of value can be cash, value script, value credit cards, prepaid telephone calling cards and the like. One such device for dispensing credit and telephone cards is described in Abe, U.S. Pat. No. 4,993,587, disclosure of which is hereby incorporated by reference. These devices include a dispensing mechanism adapted to move a card from a receptacle containing a plurality of cards retained in a stacked relationship. When the individual has paid for the card, or otherwise activated the mechanism, the dispensing mechanism removes a card from the receptacle and dispenses it. The dispensing mechanism is adapted to dispense one card at a time.

It is also known to provide such devices where they can receive and mount a magazine pre-loaded by the vendor with the value cards or other articles of value. A route operator mounts the magazine in the dispensing device and the articles are dispensed. One such magazine is as described in Kasper, U.S. Pat. No. 5,647,507. The pre-loaded magazine is loaded with cards and the magazine is locked closed. The locked and loaded magazine is mounted and secured to the dispensing mechanism. A catch is operated to latch the mechanism to the device. In response to operation of the catch, a gate on the magazine is opened to permit the cards to be dispensed.

A drawback of using pre-loaded magazines is that the route operator may surreptitiously remove cards or the other articles of value stored therein by either opening the gate, removing cards from the magazine and closing the gate prior to mounting the magazine at the dispensing mechanism or removing a magazine from the mechanism still loaded with cards, opening the gate to remove cards and closing the gate. The thief then sells or uses the stolen cards, thus depriving the route owner of the revenues. There is, accordingly, a need for a device and magazine which overcomes the drawbacks of prior devices by preventing such theft or by providing an indication of when such theft has occurred.

SUMMARY OF THE INVENTION

There is, therefore, set forth according to the present invention a device for dispensing articles of value and a magazine therefor which provides for a one-cycle gate operating mechanism by which the gate for the magazine may be opened once when the magazine is latched to the dispensing mechanism, closed when the magazine is uncoupled from the dispensing mechanism, and thereafter may not be opened again. The foregoing prevents route operators from opening the gate and surreptitiously removing cards. If the gate is opened prior to mounting the magazine to remove articles, the gate may not be opened again when latched to the dispensing device indicating theft of articles of value from the magazine. If the gate is closed to remove the magazine from the dispenser it may not be opened again preventing theft.

Toward this end, a device for dispensing articles of value is set forth which includes a dispensing mechanism for dispensing articles and a magazine for holding a plurality of the articles. The magazine includes a gate moveable from a closed position to an open position, the gate in the open position permitting an article to be moved by the dispensing mechanism from the magazine for dispensing thereof. The gate, when the magazine is initially loaded with articles is disposed in the closed position. A one-cycle gate operating mechanism is provided including a moveable actuator moveable from a first position to a second position to latch and couple the magazine to the dispensing mechanism and move the gate from the initial closed position to the open position for dispensing of articles by the dispensing mechanism. The actuator is moveable back to the first position to release the mechanism from the dispensing mechanism and close the gate. Means are provided for locking the gate in the closed position after one cycle of the actuator from the first to the second and back to the first position.

In a preferred embodiment, the one-cycle locking mechanism includes a cam and follower disposed between the gate and the actuator to displace the gate between the closed to the open position in response to rotation of the actuator. When the actuator is operated in a reverse direction to close the gate, the gate is closed and a pin inserted through an opening in the gate to secure the gate in a closed position.

Also set forth is a magazine including the one-cycle gate operating mechanism of the type described above. The magazine is well suited to be retrofit onto existing dispensing mechanisms.

Accordingly, the device and magazine according to the present invention provides for a secure magazine to hold articles of value prior to dispensing thereof. Should a route operator, upon receiving a loaded magazine, manipulate the gate to an open position to remove articles of value therefrom and close the gate, the magazine will not be able to be mounted to the dispensing mechanism. The inability to mount the magazine will provide indication of theft. Further, when the magazine actuator has been manipulated to unlatch the magazine from the dispensing mechanism for removal thereof, the gate is closed and may not be opened again by virtue of the one-cycle gate operating mechanism according to the present invention.

BRIEF DESCRIPTION OF THE DRAWINGS

These and other features and advantages will become appreciated as the same becomes better understood with reference to the Specification, Claims and Drawings wherein:

DESCRIPTION

Figure 1:
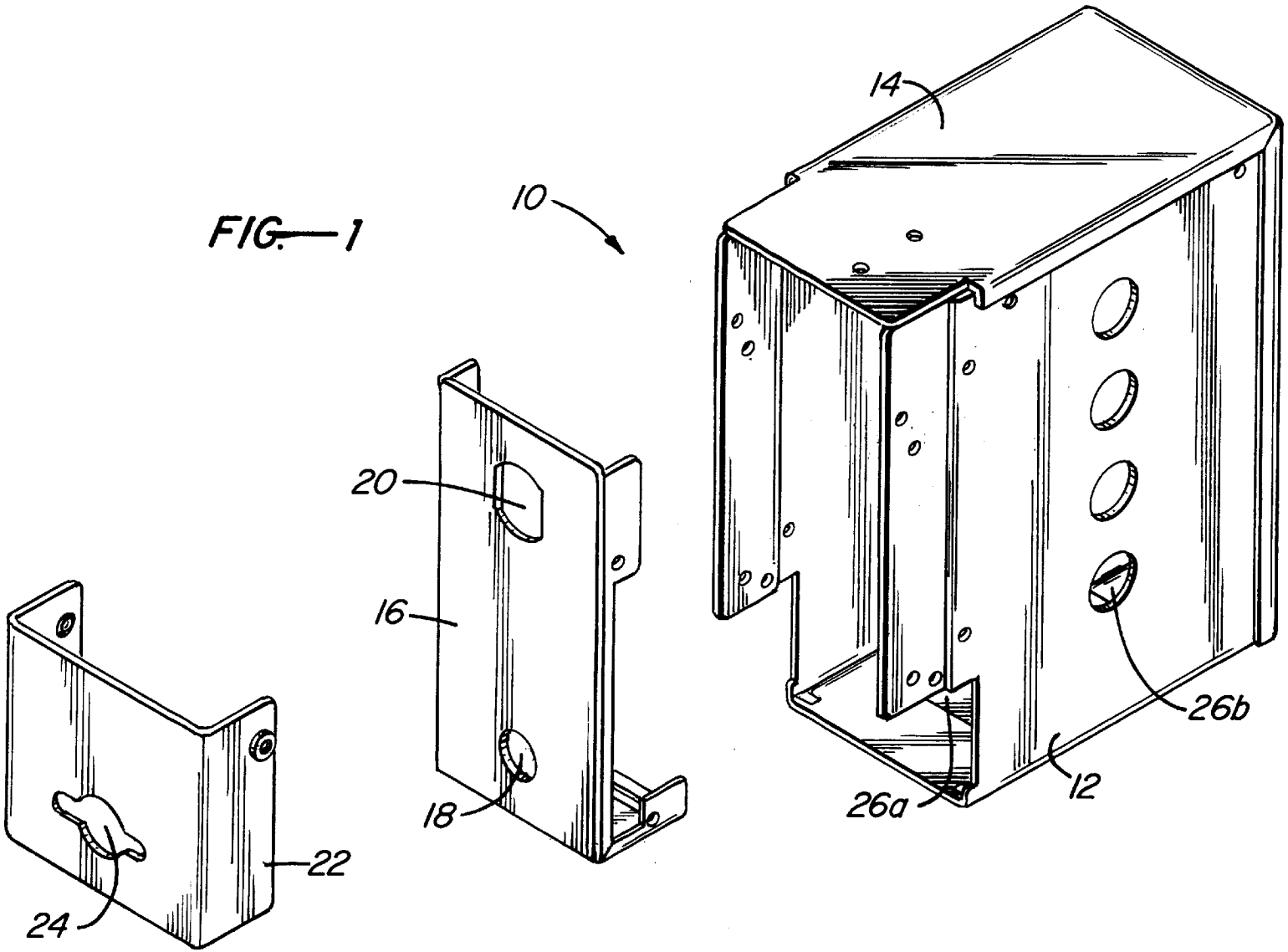
FIG. 1 is an exploded, perspective view of a magazine for retaining articles of value and a mounting bracket to cooperate therewith.

With reference to FIG. 1, a magazine 10 for holding articles of value according to the present invention as shown. The magazine includes a housing 12 having connected thereto by a hinge, an L-shaped door 14 which can be opened to provide access to the interior of the magazine 10 for loading articles of value therein, such as cash, credit cards, prepaid telephone calling cards, and the like. A front panel 16 is secured on the front of the housing 12 to provide for partial closure thereof. The front panel 16 includes a bore 18 to pass the shaft of an actuator as hereinafter described and a bore 20 to accommodate a lock for locking the door 14 to the front panel 16 to close the housing. The front panel 16 is riveted, welded, or otherwise secured to the housing 12. Not shown in FIG. 1, the door 14 includes a catch to be captured by the lock (not shown) to lock the door 14 in a closed position.

With continuing reference to FIG. 1, there is also shown an adapter bracket 22 which is secured to an existing article dispensing mechanism (not shown) to cooperate with the magazine 10 as hereinafter described to secure magazine 10 to the dispensing device. The bracket 22 has a way 24 having a central bore with diametrically opposed slots to pass the actuator handle as hereinafter described.

When closed and secured, the magazine 10 is adapted to retain articles of value in a stacked relationship therein. Openings 26*a, b*, in the bottom of the magazine 10 provide for traction wheels to engage the article on the bottom of the stack to move it from magazine 10 for dispensing thereof.

Figure 3:
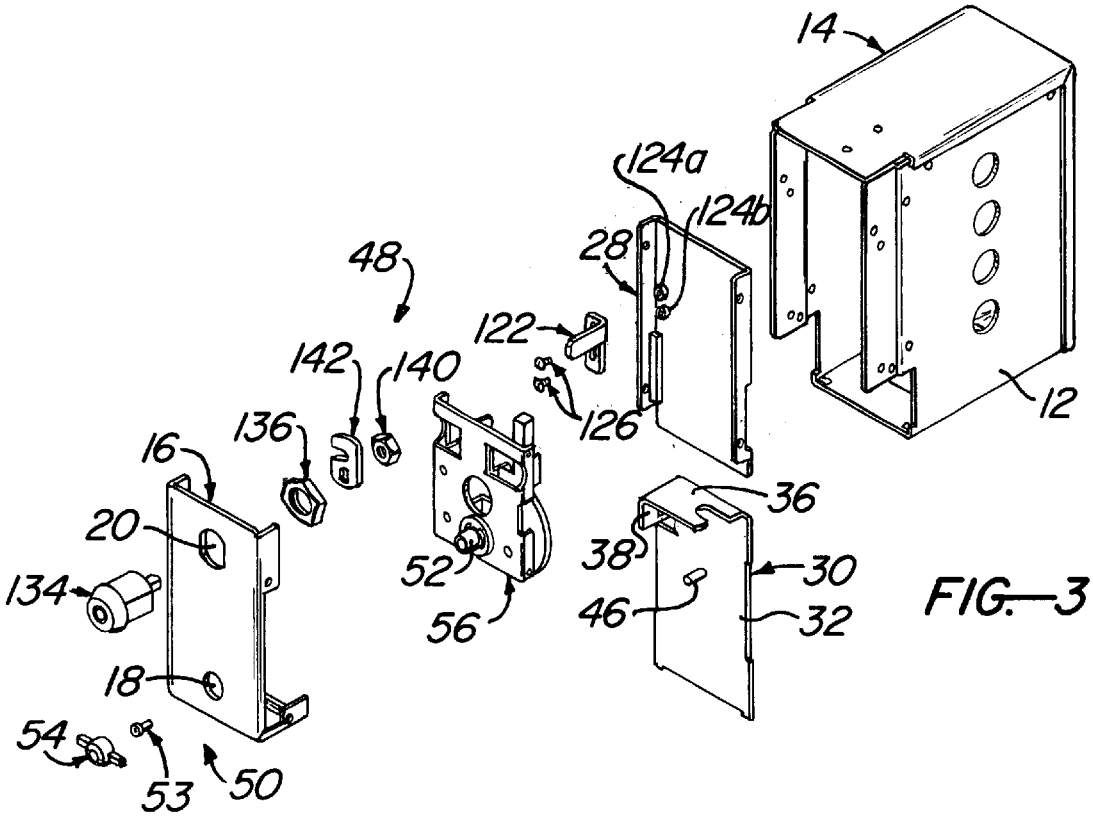
FIG. 3 is a front exploded view of certain components of the magazine including the one-cycle gate operating mechanism.
Figure 4:
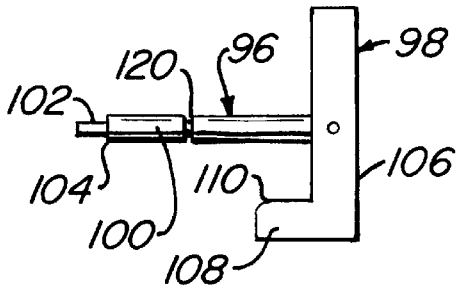
FIG. 4 is a side view of a locking pin of the one-cycle gate operating mechanism.
Figure 5:
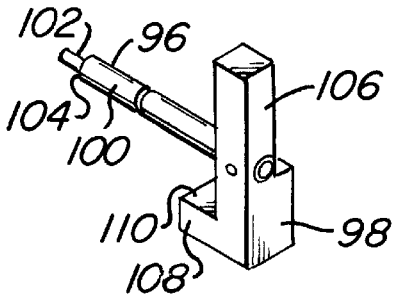
FIG. 5 is a perspective view of the pin of FIG. 4.
Figure 6:
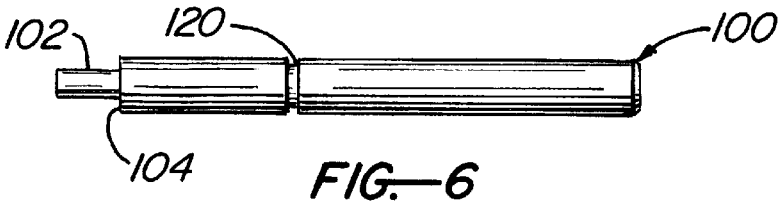
FIG. 6 is a side view of the pin of FIG. 4.
Figure 7:
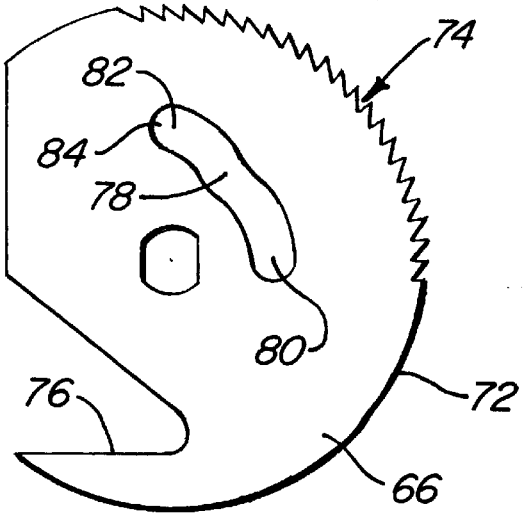
FIG. 7 is a front view of a cam for the one-cycle gate operating mechanism and defining the catch for securing the magazine to the dispensing mechanism.
Figure 8:
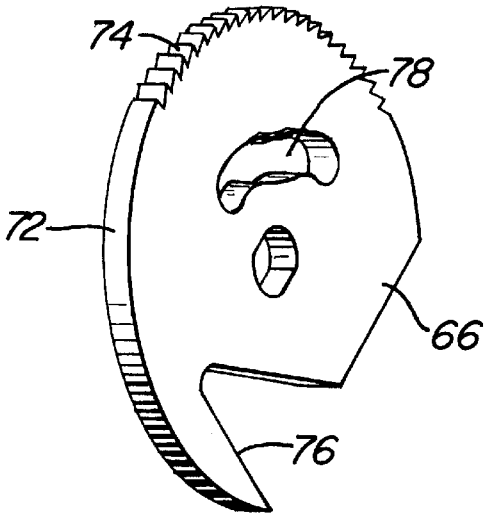
FIG. 8 is a rear perspective view of the cam of FIG. 7.

With reference to FIG. 3, the magazine 10 includes an interior partition wall 28 adapted to be mounted in the housing to be spaced rearwardly of the front panel 16. The wall 28 may be mounted by rivets, tack welding, or the like. The wall 28 is positioned within the housing 12 in relation to the side walls and door 14 to provide for a volume to be closely occupied by the stack of the articles of value, hereinafter referred to as "value cards." Disposed forwardly of the wall 28, there is included a moveable gate 30. The gate 30 is moveable from a closed position where, in cooperation with the front panel 16, the magazine is closed, to an open position defining a small passage between the bottom of the gate and the bottom wall of the housing 12 for the passage of a single value card from the magazine 10 as dispensed by the dispensing mechanism (not shown).

Figure 9:
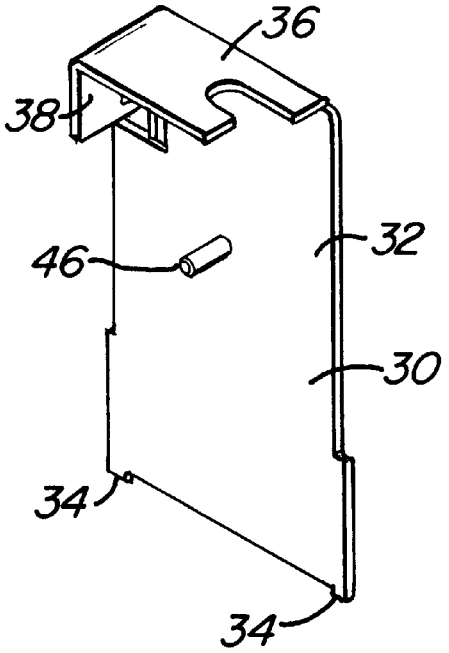
FIG. 9 is a rear perspective view of the gate for the magazine.
Figure 10:
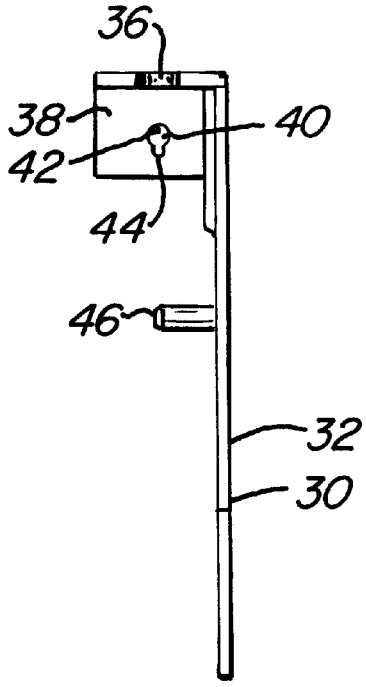
FIG. 10 is a side view of the gate for the mechanism.

The gate 30, as shown in FIGS. 3, 9 and 10, includes a flat panel 32 to close the front of the magazine 10, the panel 32 including at its bottom margin a pair of opposed tabs 34 adapted to engage the bottom wall of the housing 12 when the gate 30 is in the first, closed position. The spacing between the tabs 34 is insufficient to pass a value card from the magazine 10. Opposite the tabs 34, the gate 30 includes a top panel 36 projecting orthogonally from the panel 32 and a side panel 38 projecting orthogonally from the panel 32 and top panel 36. The side panel 38 has a pear-shaped opening 40 defined therein by a first bore 42, which intersects with and merges to a smaller diameter second bore 44. Projecting from the panel 32 is a cylindrical follower 46 adapted to engage a cam as hereinafter described.

Figure 2:
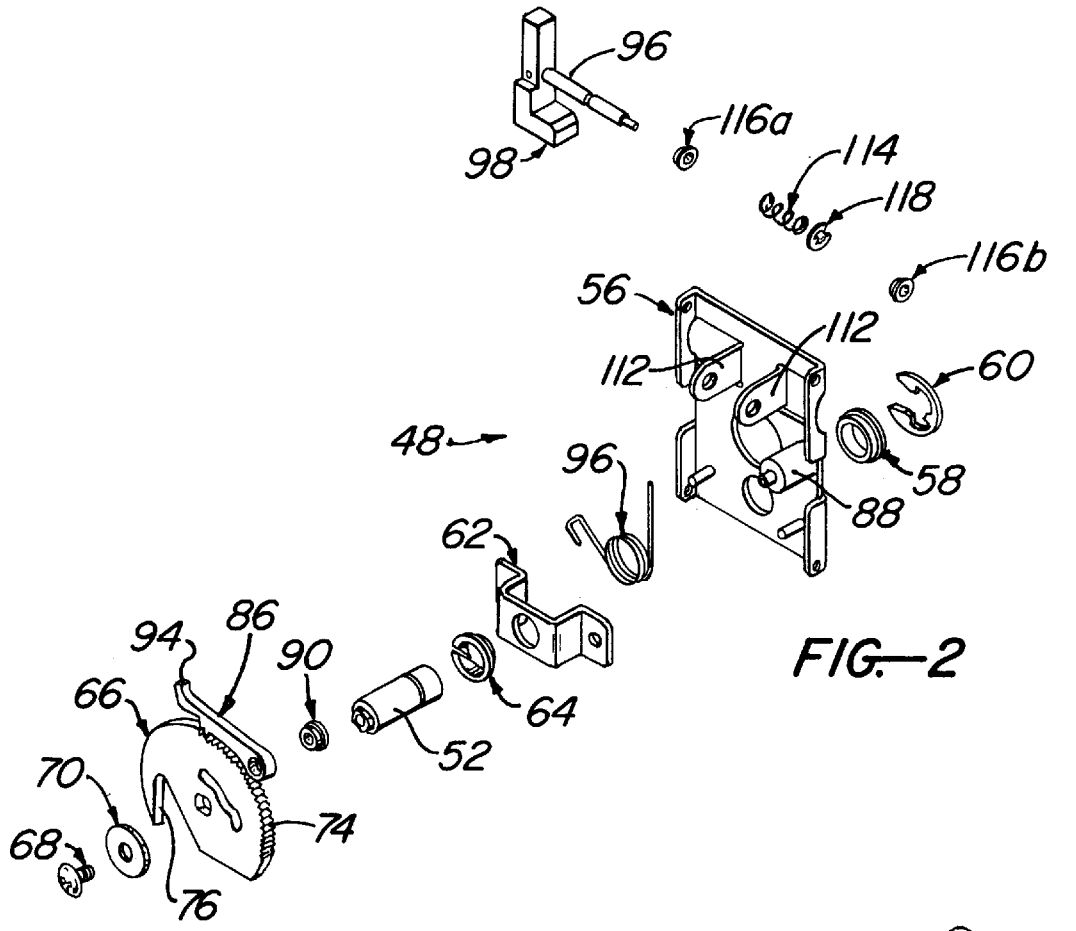
FIG. 2 is a rear exploded, perspective view of the one-cycle gate operating mechanism according to the present invention.

Returning to FIGS. 2 and 3, the magazine 10 includes a one-time gate operating mechanism 48 which includes an actuator 50 having an actuator shaft 52 adapted to project through the bore 20 of the front panel 16 and mount by a connector 53 an actuator handle 54. The handle 54 is configured to closely pass through the way 24 when the magazine 10 is mounted to the dispensing mechanism, but when the handle 54 is rotated to capture the magazine to the bracket 22 to prevent removal of the magazine 10 from the dispensing mechanism. The actuator shaft 52 is journaled through a mounting bracket 56 disposed between the gate 30 and front panel 16. The mounting bracket 56 is secured to one of the housing 12, panel 32 and/or front panel 16. With reference to FIG. 2, the reverse side of the mounting bracket 56 is illustrated. Accordingly, it is seen that the actuator shaft 52 is passed through a bearing clip 58 retained by an E-ring 60 on the actuator shaft 52. A shaft bracket 62 is secured to the back side of the mounting bracket 56 likewise passes the actuator shaft 52. A further bearing clip 64 is secured to the actuator shaft to journal it relative to the shaft bracket 62. The actuator shaft 52 opposite the handle 54 mounts a cam 66 for rotation with the actuator shaft 52 and handle 54. A screw 68 received axially into the actuator shaft 52, secures a washer 70 and the cam 66 to the actuator shaft 52.

With reference to FIGS. 2, 3, 7 and 8, the cam 66 will now be described. The cam 66 has generally a circular perimeter 72, the axis of which is aligned axially with the actuator shaft 52. A portion of the perimeter 72 includes teeth defining a ratchet surface 74, the purpose of which will hereinafter become evident. Opposed from the ratchet surface 74, the cam 66 includes a slot defining a sector-shaped catch 76 which is adapted to engage structure on the dispensing mechanism to secure the magazine 10 thereto. When the cam 66 is rotated to its fullest extent, as described below, the catch 76 engages a cooperating surface on the dispensing mechanism to couple the magazine 10 thereto. The cam 66 also includes a cam slot 78 adapted to receive the follower 46 of the gate 30. The cam slot 78 includes a first portion 80 which acts as a lost motion section. Rotation of the cam 66 with the follower 46 in the first portion 80 does not result in any movement of the gate 30. The first portion 80 transitions into a second portion 82 which is adapted, upon rotation of the cam 66, to urge the gate 30 upwardly to open the magazine 10 for dispensing of value cards. The second portion 82, when the cam 66 is fully rotated, nests the follower 46 at end 84. When the follower 46 is so positioned, the gate 30 is opened to its greatest extent, an extent adapted to pass a singular article of value from the magazine 10. Tabs 34 on the gate 30 define the aforementioned passageway for dispensing of a value card from the magazine 10 when the dispensing mechanism is operated.

Returning to FIGS. 2 and 3, means are provided for preventing reverse rotation of the cam 66 as it moves from a first, retracted position to the second position whereat the catch 76 engages and captures the structure on the dispensing mechanism to secure the magazine 10 thereto. These means include a pawl 86 to engage the ratchet surface 74 on the perimeter of the cam 66. A mount 88 on the shaft bracket 62 mounts the pawl 86. A bearing clip 90 is disposed between the mount 88 and pawl 86 to reduce friction against pivoting of the pawl 86 as hereinafter described. A torsion spring 96 is mounted between the shaft bracket 82 and pawl 86 to urge the pawl 86 to engage the ratchet surface 74. At an end opposite the connection between the pawl 86 and mount 88, there is included an upturned leg 94 adapted to be engaged, as hereinafter described, to disengage the pawl 86 from the ratchet surface 74.

To lock the gate 30 in a closed position after one cycle of opening and closing thereof, the gate operating mechanism 48 includes a pin 96 secured to a pin 96. The pin block 98, as shown in FIGS. 2, 4 through 6, includes a round shaft 100 secured at one end to the pin block 98 and having at the other end an axially disposed and smaller diameter finger 102. The finger 102 and shaft 100 define a circumferential shoulder 104 for the pin 96. The pin block 98 includes a rectangular post 106 having at one end an orthogonally disposed pawl engaging foot 108. The foot 108 has a beveled surface 110 adapted to engage the leg 94 of the pawl 86 as hereinafter described.

The pin 96 is slidably mounted between a pair of spaced pin brackets 112 disposed on the shaft bracket 62. Bearing clips 116*a, b*, are disposed between the pin 96 and pin brackets 112 to provide for sliding thereof. An E-ring 118 connected in a groove 120 about the pin 96 captures the spring 114 between it and a pin bracket 112 to provide the aforementioned bias upon the pin 96.

Figure 11:
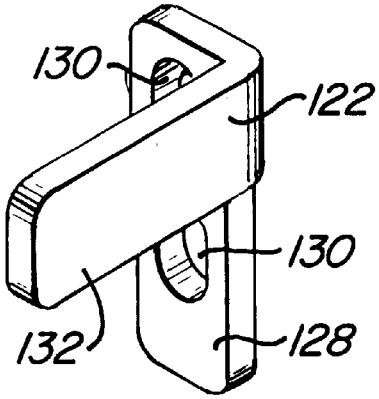
FIG. 11 is a perspective view of a slider of the one-cycle gate operating mechanism.
Figure 12:
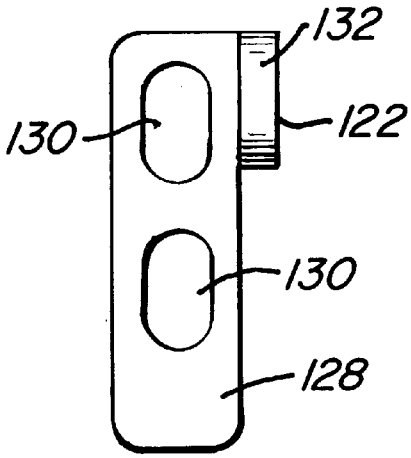
FIG. 12 is a front view of the slider of FIG. 11.

The gate operating mechanism 48 also includes a slider 122 as best shown in FIGS. 3, 11 and 12. The slider 122 is mounted to a pair of spaced slider mounts 124*a, b*, disposed on the wall 28 by a pair of screws 126. The slider 122 has a base 128 with a pair of openings 130 to pass the slider mounts 124*a, b*. The openings 130 are elongated to provide for a degree of vertical movement of the slider 122 along the wall 28 as hereinafter described. Projecting orthogonally from the base 128, the slider 122 includes an arm 132 adapted to, when the gate operating mechanism 48 is assembled, to contact the gate side panel 38.

Returning to FIG. 3, the magazine 10 includes a door lock 134 which is received through the front panel bore 20 and is secured thereto by a nut 136. Mounted to the shaft 138 for the door lock 134 by a nut 140 is a catch 142. Reception of a key into the door lock 134 frees the tumblers for rotation of the lock shaft 138 and the catch 142 secured thereto, the catch 142 capturing a surface (not shown) on the underside of the door 14 to lock the door 14 in a closed position on the housing 12.

Turning to FIGS. 2 and 3, the operation of the one-cycle lock provided by the gate operating mechanism 48 and according to the present invention will now be described. The door 14 of the magazine 10 is opened by inserting a proper key into the door lock 134 and rotating the shaft 138 to release the catch 142. The door 14 is opened and a plurality of value cards are stacked in the housing 12. The door 14 is closed and locked by the door lock 134. In this position, the gate 30 is lowered against the bottom of the housing 12 to prevent removal of the value cards.

The loaded magazine 10 is thereafter mounted to the dispensing mechanism. Typically, the magazine 10 is positioned and moved forwardly on the dispensing mechanism such that the handle 134 passes through the way 24 on the bracket 22. Other capture surfaces are typically provided to mechanically secure the magazine 10 to the dispensing mechanism. If required, the bracket may be provided and secured to the dispensing mechanism to mount the magazine 10. With the gate 30 in the lowered position, the handle 54 is orientated to move through the way 24 and the magazine 10 is mounted. The handle 54 is thereafter rotated which rotates the cam 66 with the pawl 86 following the ratchet surface 74. The rotation of the cam from a gate closed position to a gate open position moves the catch 78 of the cam 66 outwardly from the magazine 10 toward a position to capture structure on the dispensing mechanism and lock the magazine 10 thereto. As the cam 66 is rotated, the follower 46 follows the cam slot 78. During the first portion of rotation of the cam 66, rotation of the cam 66 does not move the gate 30 in that the follower 46 is in the cam slot first portion 80. Continued rotation of the handle 54 causes the follower 46 of the gate 30 to enter the cam slot second portion 82 whereupon additional rotation of the cam 66 urges the gate 30 upwardly to open the magazine 10. When the handle 54 has been rotated such that the catch 76 has engaged the cooperating structure on the dispensing mechanism, the magazine 10 is mounted thereto. The follower 46 is at end 84 of the cam slot 78 and the catch 76 is fully deployed to capture and mount the magazine 10 unless the catch 76 is fully deployed, the magazine 10 cannot be mounted to the dispensing mechanism.

The pin 96, when the gate 30 is in the closed position is disposed to pass its finger 102 through the first bore 42 of the gate 30. The location of the slider 122 proximate the side panel 138 of the gate 30 is contacted by the finger 102 to pass only the finger 102 through the first bore 42. Furthermore, the finger 102 of the pin 96 is sufficiently small in diameter to also be adapted to be received in the smaller second bore 44 of the gate side panel 38. As the gate 30 is raised, by virtue of the engagement between its follower 46 and the cam slot 78, the gate 30 moves upwardly a distance defined by the vertical distance of the first and second bores 42, 44 of the gate side panel 38. Thus, in the closed position, the finger 102 is disposed of the first bore 42, and when the gate 30 is in a second, open position, the finger 102 is within the second bore 44. As the gate 30 is moved upwardly by engagement between the follower 46 and cam slot second portion 82, the slider 122 moves upwardly with the gate 30 while still preventing insertion of the pin shaft 100 through the first bore 42. The slider 122 frictionally engages the gate side panel 38 for the cooperative movement therewith. At such time as the finger 102 of the pin 96 registers with the second bore 44, the slider 122 is moved out of a blocking position of the pin, and the pin 96 moves forwardly to insert the finger 102 fully through the second bore 44 restrained by the shoulder 104 engaging the side panel 38. In this position, the gate 30 is fully raised. The finger 102 retains the slider 122 in the raised position.

The movement of the pin 96 and pin block 98 when cleared by the slider 122 for insertion of the finger 102 through the second bore 44, urges the pin block foot 108 to engage the pawl 86 and to pivot it against restraining engagement with the ratchet surface 74. Thus, in the fully raised position, the catch 76 of the cam 66 has engaged structure on the dispensing mechanism to secure the magazine thereto, the gate 30 is fully raised with the pin finger 102 fully inserted through the second bore 44 of the gate side panel 38 and the pawl 86 is raised from the ratchet surface 74 to provide for reverse rotation of the cam 66. With the gate 30 in the raised position, value cards may be dispensed from the magazine 10.

When it is desired to remove the magazine 10 from the dispensing mechanism, the handle 54 is reversely rotated to disengage the catch 76 from the structure on the dispensing mechanism and to align the handle 54 for removal through the way 24. The reverse rotation of the handle 54 reversely rotates the cam 66 pulling the gate 30 downwardly toward the closed position. As the gate 30 reaches the closed position, the first bore 42 of the gate side panel 38 aligns with the pin shaft 100 and, by virtue of the spring 114, the pin 96 is inserted through the first bore 42 to lock the gate 30 in closed position. The pin 96 in this position passes cooperatively through the bores in the in brackets 112 and the first bore 42 of the gate side panel 38. In this position, the handle 54 may be reversely rotated in an attempt to open the gate 30; however, the fixing of the gate 30 by the pin 96 prevents rotation of the cam 66 by virtue of the engagement of the gate follower 46 in the cam slot second portion 82. Thus, the cam 66 may not be reversely rotated to open the gate 30 or to secure the magazine 10 back to the dispensing mechanism. In the closed position, the slider 122 is in a raised position held by its engagement with the finger 102 of the pin 96.

To reset the gate operating mechanism 44, the key is inserted in the door lock 134 to open the door 14 from the housing 12. With the door 14 open, the user urges the pin post 106 leftwardly (FIG. 2) allowing the slider 122 to drop by gravity and assume its original position. The movement of the pin block 98 also urges the foot 108 from the pawl 86 which returns under the bias of the torsion spring 92 to engage the ratchet surface 74.

As can be appreciated, the gate operating mechanism 48 according to the present invention prevents theft of value cards and other articles from the magazine 10. Should an individual take a loaded magazine 10 and attempt to remove value cards, they may operate the gate to the open position as described above and thereafter close the gate 30. However, once the gate operating mechanism 48 has been cycled from closed to an open and back to a closed position, the gate 30 may not again be opened, and the magazine 10 may not be placed in the dispensing mechanism. The insertion of the pin 96 to fix the gate 30 in the closed position once the operating mechanism 48 has been cycled prevents the gate 30 from being again opened and prevents rotation of the cam 66 to have its catch 76 engage the structure on the dispensing mechanism. Still further, should the operator attempt to move the gate 30 upwardly just short of the fully open position and thereafter attempt to reversely rotate the handle 54 to close the gate 30, the reverse rotation is prevented by engagement of the pawl 86 with the ratchet surface 74 on the cam 66. Thus, reverse rotation of the handle 54 and cam 66 is only permitted when the gate 30 has been raised fully to the raised position freeing the pin foot 108 to engage the pawl leg 94 and permit reverse rotation of the cam 66.

Thus, it can be understood that the magazine 10 including the gate operating mechanism 48 can prevent and frustrate theft from the magazine 10. A route operator removing articles from the magazine will find that the magazine can no longer be placed in the dispensing mechanism and therefore would be required to explain the situation. Further, a magazine 10 removed from the dispensing mechanism and still including value cards, may not again be opened to remove the remainder of cards.

While I have shown and described certain embodiments of the present invention, it is to be understood that it is subject to many modifications and changes without departing from the spirit and scope of the claims.

I claim:

1. A device for dispensing articles of value comprising:

a dispensing mechanism for dispensing said articles;

a closed magazine for holding a plurality of said articles, said magazine including, (i) a gate moveable from a closed position to an open position, said gate in said open position permitting an article to be moved by the dispensing mechanism from the magazine for dispensing thereof, said gate when said magazine is initially loaded with articles disposed in the closed position, (ii) a one-cycle gate operating mechanism including a moveable actuator moveable from a first position to a second position to secure the magazine to the dispensing mechanism and coupled to the gate for moving the gate from the initial closed position to the open position for dispensing of articles by the dispensing mechanism and back to the first position to release the magazine from the dispensing mechanism and close the gate; and (iii) means for locking the gate in the closed position after one cycle of the actuator from said first to said second and back to said first position.

2. The device of claim 1 including a catch moveable to a latched position to couple said magazine to said dispensing mechanism in response to movement of said actuator from the first to the second position, said gate operating mechanism after said one cycle locking said catch against movement to said latched position.

3. The device of claim 1 wherein said actuator is rotatable and coupled to a catch, rotation of said actuator from the first to the second position rotating the catch to secure the magazine to the dispensing mechanism and moving the gate to the open position, rotation of the actuator from the second back to the first position disengaging the catch and closing the gate.

4. The device of claim 3 wherein the one cycle locking mechanism includes a cam and follower disposed between said gate and said actuator to displace the gate between the first to the open second position in response to rotation of the actuator, means for preventing reverse rotation of said actuator until said gate has reached the second position, reverse rotation of the actuator from the second to the first position engaging said gate locking means to lock the gate in the closed position and secure the actuator against rotation back to said second position.

5. The device of claim 4 wherein said reverse rotation preventing means includes a ratchet surface on said cam and a pawl urged to engage said ratchet surface and permit rotation thereof only in the direction from said first position to said second position and a release adapted to disengage the pawl from the ratchet surface when said actuator is at said second position.

6. The device of claim 5 wherein said gate locking means and said release includes a pin moveable from a first to a second position to lock said gate when said gate is returned from said second position back to said first position.

7. The device of claim 6 wherein said gate includes an bore to receive said pin to lock said gate in the closed position.

8. The device of claim 6 wherein said bore is pear shaped including a major bore and a smaller diameter minor bore and said pin includes a shaft of a size to pass only said major bore, an axially extending finger adapted to pass through said minor and said major bores and a slider, said finger passing through said minor bore when said gate is at the second position, movement of the gate to the first position extending the finger shaft through the major bore to lock the gate in the closed position.

9. A device for dispensing articles of value comprising:

a dispensing mechanism for dispensing said articles;

a closed magazine for holding a plurality of said articles, said magazine including, (i) a gate moveable from a closed position to an open position, said gate in said open position permitting an article to be moved by the dispensing mechanism from the magazine for dispensing thereof, said gate when said magazine is initially loaded with articles disposed in the closed position, (ii) a one-cycle gate operating mechanism including a moveable actuator moveable from a first position to a second position to secure the magazine to the dispensing mechanism and coupled to the gate for moving the gate from the initial closed position to the open position for dispensing of articles by the dispensing mechanism and back to the first position to release the magazine from the dispensing mechanism and close the gate and means for locking the gate in the closed position after one cycle of the actuator from said first to said second and back to said first position, said locking means including a cam and follower coupled between said actuator and said gate to move said gate between said open and closed positions in response to movement of the actuator, an axially moveable pin, said gate including a pear shaped bore including a major bore and a smaller diameter minor bore and said pin includes a shaft of a size to pass only said major bore, an axially extending finger adapted to pass through said minor and said major bores and a slider, said finger passing through said minor bore to engage said slider when said gate is at the second position, movement of the gate to the second position passing the finger through the major bore, said pin shaft restrained from insertion into said major bore by said slider and movement of said gate back toward said first position extending the finger through the major bore to lock the gate in the closed position.

10. A magazine for an article dispensing device of the type having a frame, article dispensing means and means for mounting a magazine containing a plurality of articles to be dispensed, said magazine comprising:

a closed housing to retain a plurality of articles to be dispensed, said housing including a gate moveable between a closed position to an open position to pass an article being dispensed from the magazine by the article dispensing means;

a moveable catch for securing the magazine to the dispensing device;

an actuator for manipulating the catch;

a gate mechanism including means for moving the gate from said closed to said open position in response to manipulation of said actuator to secure the magazine to the dispensing device, and for closing the gate in response to manipulation of the actuator to release the catch and magazine from the dispensing device; and means for locking the gate in a closed position after one cycle of opening the gate and closing the gate.

11. The magazine of claim 10 wherein said locking means includes a pin and means for urging the pin to fix the gate to the magazine in the closed position in response to one cycle of opening and closing the gate.

12. The magazine of claim 11 wherein said urging means includes said pin having a shaft and a smaller diameter axially projecting finger and said gate includes a pear shaped bore defined by a major bor and a smaller diameter minor bore, said minor bore passing said finger when said gate is in the closed position, movement of the gate to the second position passing the finger through the major bore, said pin shaft restrained by restraining means from insertion into said major bore and movement of said gate back toward said first position extending the finger through the major bore to lock the gate in the closed position.

* * * * *